US008024949B2

(12) United States Patent
Shore et al.

(10) Patent No.: US 8,024,949 B2
(45) Date of Patent: Sep. 27, 2011

(54) APPARATUS FOR DECELERATING AND TEMPORARILY ACCUMULATING HOT ROLLED PRODUCT

(75) Inventors: T. Michael Shore, Princeton, MA (US); Matthew Palfreman, Charlton, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 564 days.

(21) Appl. No.: 12/272,007

(22) Filed: Nov. 17, 2008

(65) Prior Publication Data

US 2010/0242560 A1 Sep. 30, 2010

(51) Int. Cl.
*B21D 11/00* (2006.01)

(52) U.S. Cl. ..... 72/66; 72/134; 72/231

(58) Field of Classification Search ..... 72/66, 227, 72/230, 231, 250, 426, 428, 135, 138, 142–145, 72/166–175, 79, 95, 96, 122, 133, 134
See application file for complete search history.

(56) References Cited

U.S. PATENT DOCUMENTS

| | | | | |
|---|---|---|---|---|
| 351,840 | A | 11/1886 | Lenox | |
| 1,935,048 | A | 8/1932 | Gassen | |
| 3,486,359 | A | 12/1969 | Hein | |
| 3,729,972 | A | 5/1973 | Kocks | |
| 3,774,433 | A | 11/1973 | Pauels | |
| 3,942,350 | A | 3/1976 | Brauer et al. | |
| 4,028,920 | A | 6/1977 | Zander | |
| 4,310,031 | A | 1/1982 | Appel et al. | |
| 4,457,154 | A | 7/1984 | Ohba | |
| 5,307,663 | A | 5/1994 | Shore et al. | |
| 5,312,065 | A * | 5/1994 | Shore et al. | 242/361 |
| 5,595,354 | A | 1/1997 | Josoff | |
| 5,893,288 | A | 4/1999 | Shore | |
| 7,021,103 | B2 | 4/2006 | Shore | |
| 7,093,472 | B1 * | 8/2006 | Shore et al. | 72/227 |
| 2002/0177972 | A1 | 11/2002 | Riches et al. | |
| 2004/0250590 | A1 | 12/2004 | Shore | |

FOREIGN PATENT DOCUMENTS

| | | |
|---|---|---|
| EP | 0815973 | 1/1998 |
| JP | 02-2355181 | 9/1990 |
| JP | 2002-126817 | 5/2002 |

* cited by examiner

*Primary Examiner* — Dana Ross
*Assistant Examiner* — Matthew G Katcoff

(57) ABSTRACT

An apparatus is disclosed for decelerating and temporarily accumulating a hot rolled product moving longitudinally along a first axis at a first velocity $V_1$. The apparatus comprises a curved guide with an entry end aligned with the first axis to receive the product, and with an exit end spaced radially from the first axis and orientated to deliver the product in an exit direction transverse to the first axis. The curved guide is rotatable about the first axis in a direction opposite to the exit direction of the product and at a speed at which its exit end has a second velocity $V_2$ lower than $V_1$ and such that the product is delivered from the exit end as a helical formation of rings and at a third velocity $V_3$ equal to $V_1-V_2$. A cylindrical drum is arranged to axially receive the helical formation of rings and to rotate about the first axis in a direction opposite to the direction of rotation of the curved guide and at a speed such that the product is unwound from the drum at the third velocity $V_3$. A receiver moves to and fro along a path parallel to the first axis to receive the product being unwound from the drum. A shroud is configured to partially encircle the drum, and rotatable interior rollers are circumferentially spaced around the interior of the shroud. The interior rollers are spaced radially from the surface of the drum and extend in parallel relationship with the first axis.

11 Claims, 9 Drawing Sheets

APPARATUS FOR DECELERATING AND TEMPORARILY ACCUMULATING HOT ROLLED PRODUCT

BACKGROUND DISCUSSION

1. Field of the Invention

This invention relates to accumulators employed in rolling mills to temporarily accumulate and decelerate hot rolled products. Examples of such accumulators are described in U.S. Pat. Nos. 7,021,103 and 7,093,472, the descriptions of which are herein incorporated by reference.

2. Description of the Prior Art

In accumulators of the above-mentioned type, as depicted diagrammatically at 10 in FIGS. 8 and 9, a curved guide 12 has an entry end 12*a* aligned with a first axis $A_1$ to receive a hot rolled product traveling at a first velocity $V_1$. The guide has an exit end 12*b* spaced radially from axis $A_1$ and orientated to deliver the product in an exit direction along a second axis $A_2$ transverse to axis $A_1$. The guide 12 is rotatable about axis $A_1$ in a direction opposite to the exit direction of the product and at a speed at which its exit end 12*b* has a second velocity $V_2$ lower than velocity $V_1$. The product is thus delivered from the exit end 12*b* as a helical formation of rings R at a third velocity $V_3$ equal to $V_1-V_2$.

A cylindrical drum 14 is arranged to axially receive the rings R. The drum is rotatable about axis $A_1$ in a direction opposite to the direction of rotation of guide 12 and at a speed such that the product is unwound from the drum at velocity $V_3$.

A receiving means in the form of a catcher 16 receives the product being unwound from the drum and serves to direct the product to other equipment (not shown) for further processing. The catcher is movable in opposite directions along a path parallel to axis $A_1$ in order to maintain its alignment with the product being unwound from the drum.

Ideally, the mill control system will maintain a balanced relationship between the rotational velocity $V_2$ of the delivery end 12*b* of the curved guide and the incoming velocity $V_1$ of the product, with the objective being to provide the accumulating rings R with inner diameters only slightly larger than the diameter of the drum surface. This in turn will minimize frictional resistance to the gradual shifting of the rings along the drum surface in the direction of axis $A_1$, while also maintaining a stable helical ring pattern on the drum.

In practice, however, velocity $V_1$ may undergo sudden and random variations due to unsteady rolling conditions in the mill. If the mill control system is incapable of reacting to such variations with sufficient speed, the diameters of the rings may either increase or decrease to an undesirable extent. If the rings become too small, resulting in the product being tightly wound on the drum, the resulting frictional resistance will impede shifting of the rings along the drum surface. On the other hand, if the rings become too large, the helical ring pattern may be upset, leading to difficulties in unwinding the product from the drum.

The objective of the present invention is to provide means for dealing with both of these potential problems.

SUMMARY OF THE INVENTION

In accordance with one aspect of the present invention, a shroud is configured to partially encircle the drum. Rotatable interior rollers are circumferentially spaced around the interior of the shroud. The interior rollers are spaced radially from the drum surface and extend in parallel relationship with the drum axis. A circumferential gap in the shroud serves to accommodate reciprocal movement of the catcher in a direction parallel to the drum axis. Preferably, the interior rollers are staggered in the direction of the drum axis, with overlapping ends.

In accordance with another aspect of the present invention, rotatable exterior rollers are circumferentially spaced around the surface of the drum. The exterior rollers also extend in parallel relationship with the drum axis, and preferably are staggered in the direction of the drum axis with overlapping ends.

The shroud and its interior rollers serve to radially confine the rings in the event that their diameters become too large, whereas the exterior rollers on the drum surface serve to radially support the rings in the event that they become too small and tightly wound on the drum.

In accordance with still another aspect of the present invention, a means is provided for urging and controlling the ordered shifting of the helical formation of rings along the surface of the drum.

These and other features and resulting advantages of the present invention will now be described in greater detail with reference to the accompanying drawings wherein:

DETAILED DESCRIPTION

Figure 1:
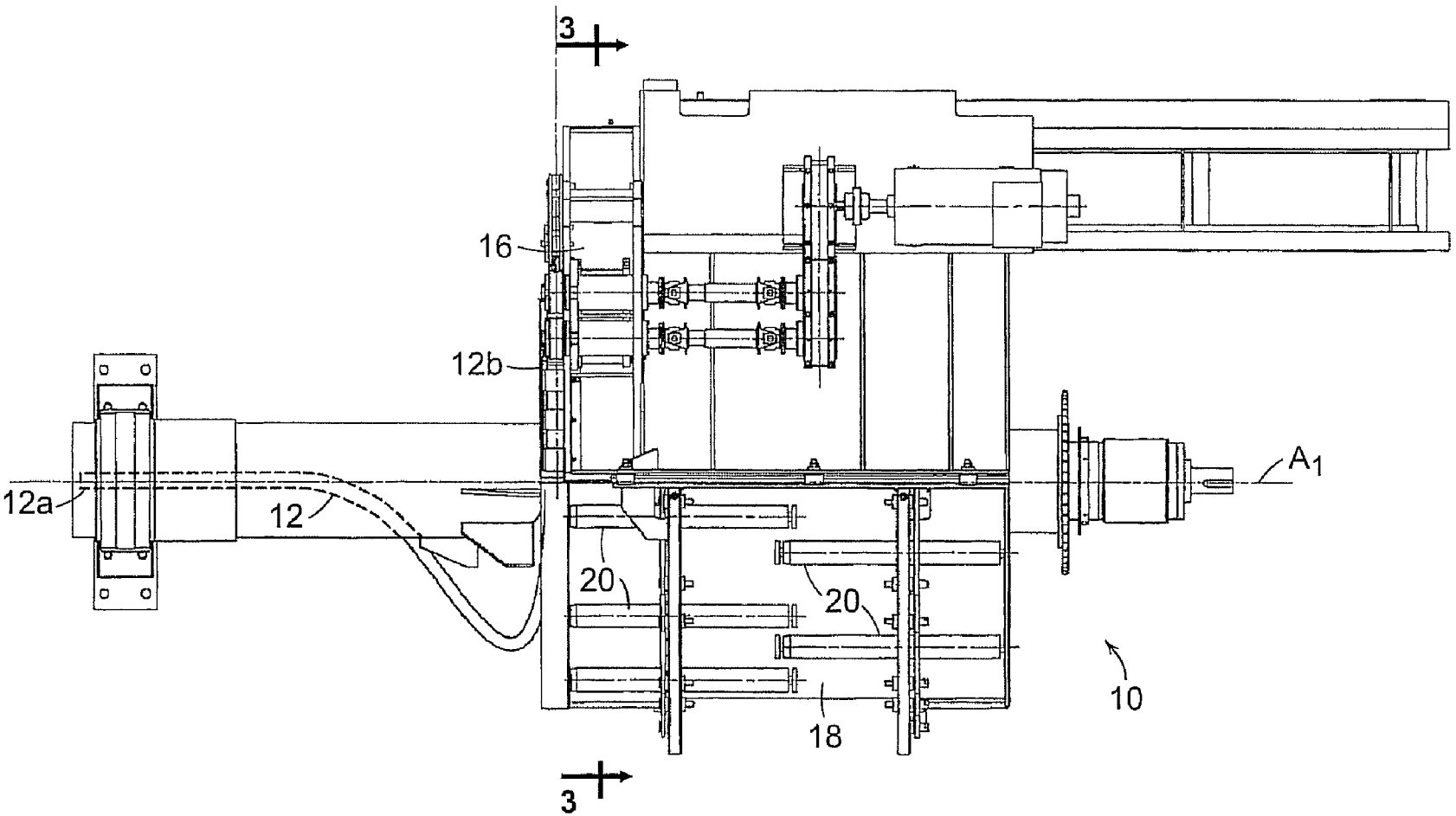
FIG. 1 is a top plan view of an accumulator in accordance with the present invention.
Figure 2:
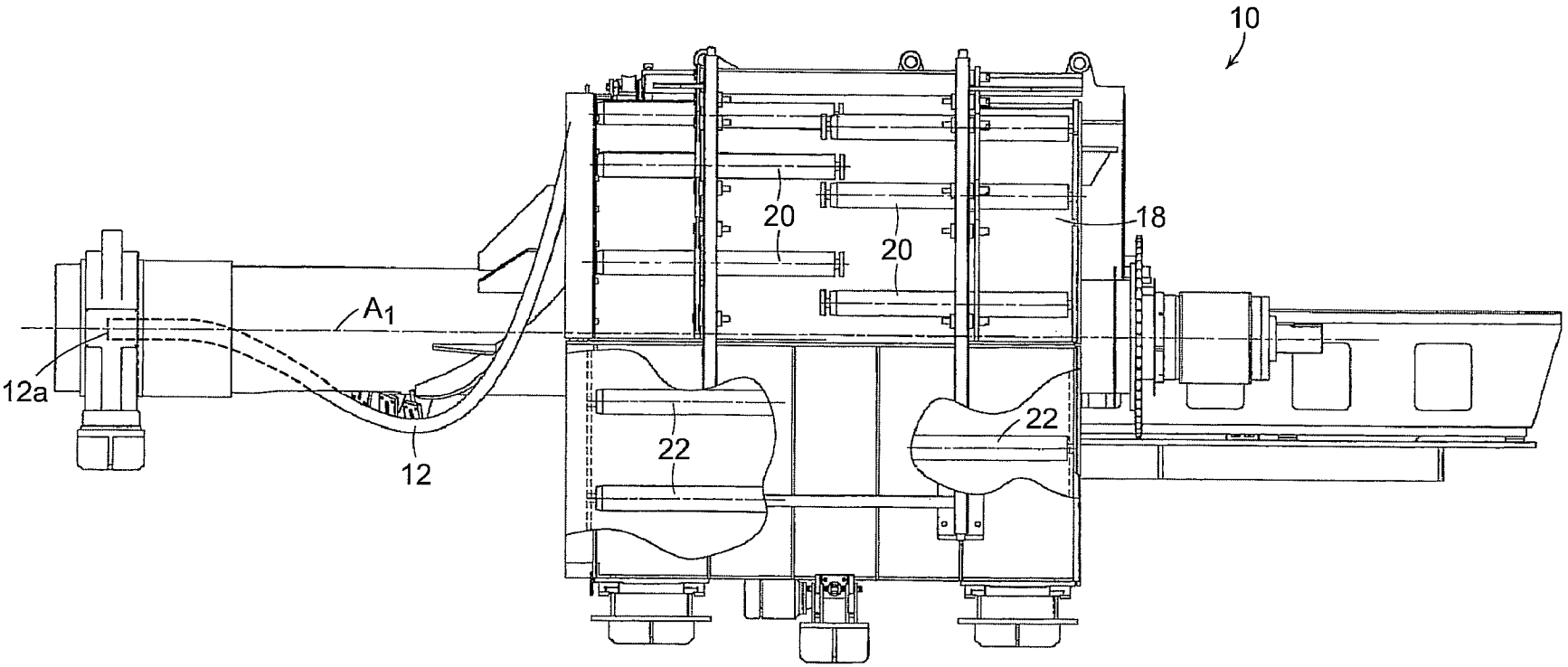
FIG. 2 is a side view of the accumulator, with portions of the shroud broken away.
Figure 3:
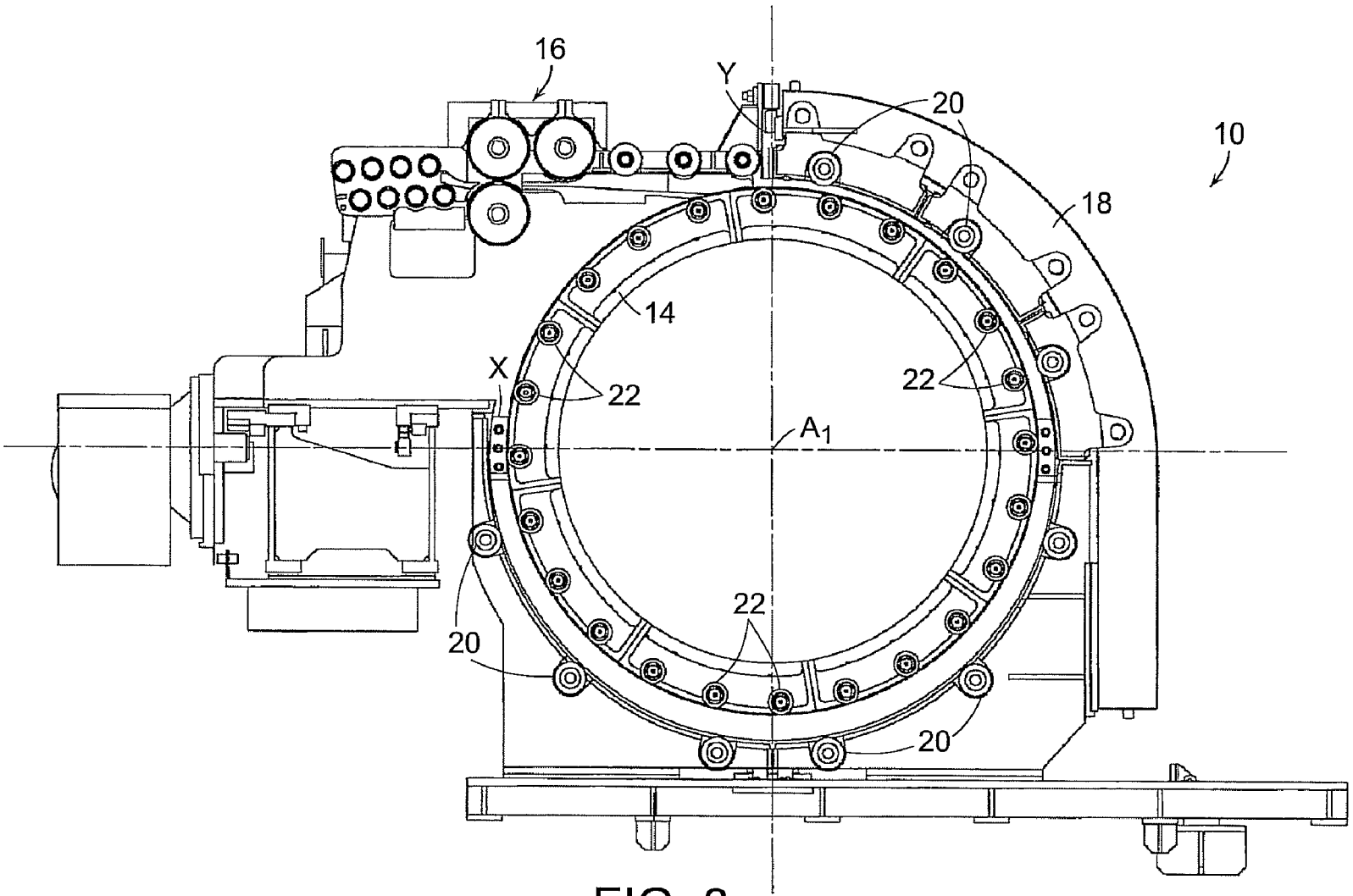
FIG. 3 is a cross-sectional view taken along line 3-3 of FIG. 1.

In accordance with a first aspect of the present invention, and as depicted in FIGS. 1-3, a stationary shroud 18 partially encircles the drum 14, leaving a circumferential gap between the locations designated at "X" and "Y". The shroud carries a plurality of rotatable interior rollers indicated typically at 20. The rollers 20 are spaced radially from the drum surface and extend in parallel relationship to the drum axis $A_1$. As can best be seen in FIGS. 1 and 2, the rollers 20 are preferably staggered in the direction of axis $A_1$, with overlapping ends.

The gap between locations X and Y provides an unobstructed path for the movement, to and fro, of the catcher 16 during unwinding of the product from the drum.

In accordance with a second aspect of the present invention, a plurality of exterior rollers 22 are spaced around the surface of the drum 14. The rollers 22 also are staggered in the direction of the drum axis, with overlapping ends.

In the event that the diameters of the rings R accumulating on the drum undergo excessive growth, the interior rollers 20 on the shroud 18 will provide radial confinement to thereby preserve the helical ring formation. Alternatively, if the ring diameters decrease to an extent such that the product begins to wind tightly around the drum, the exterior rollers 22 will serve to minimize frictional resistance to the shifting of the rings along the drum surface in the direction of axis $A_1$.

Figure 4:
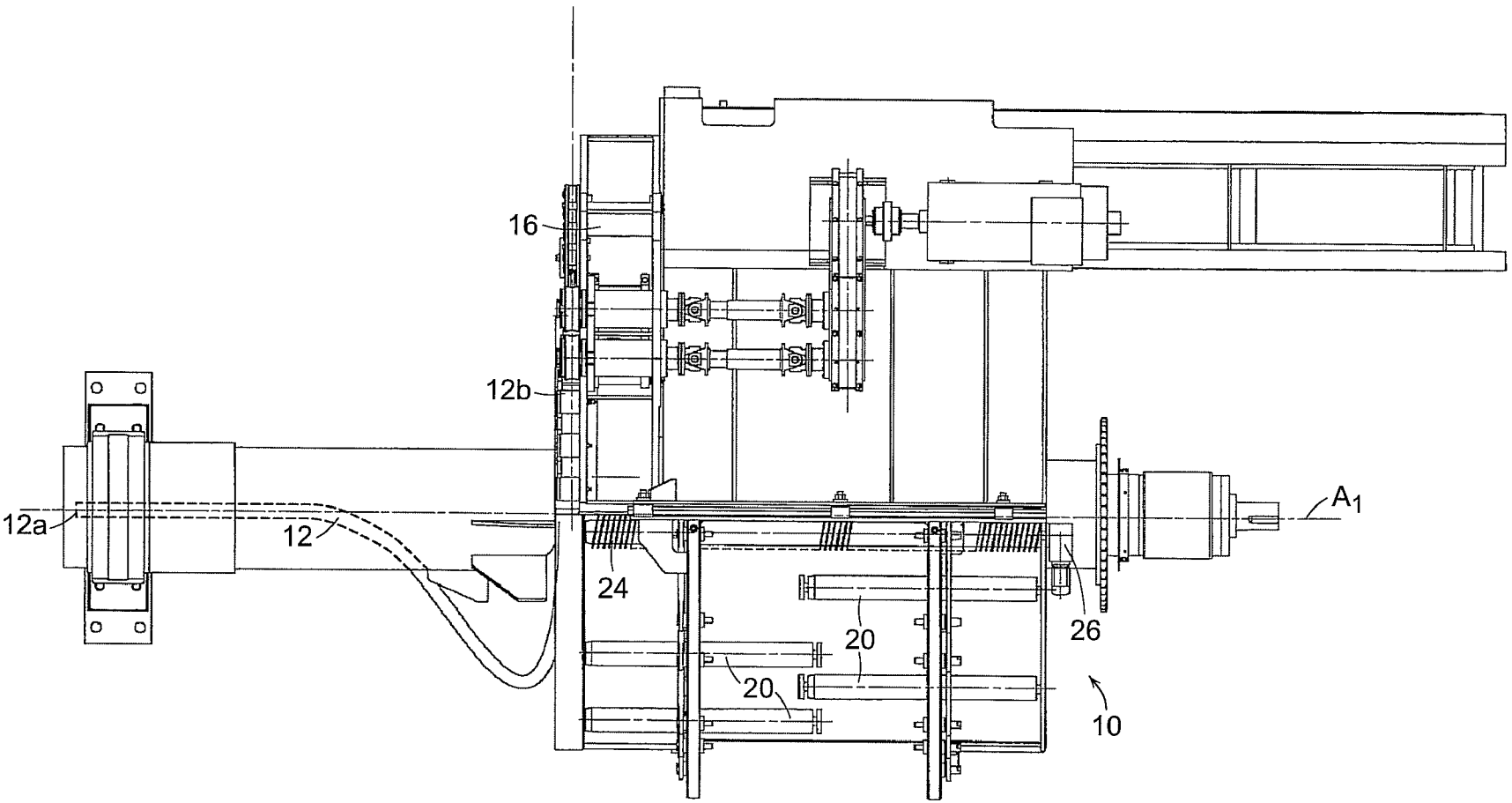
FIGS. 4 and 5 are views similar respectively to FIGS. 1 and 2 showing one embodiment of a means for urging and controlling the ordered shifting of the helical formation of rings along the drum surface.
Figure 5:
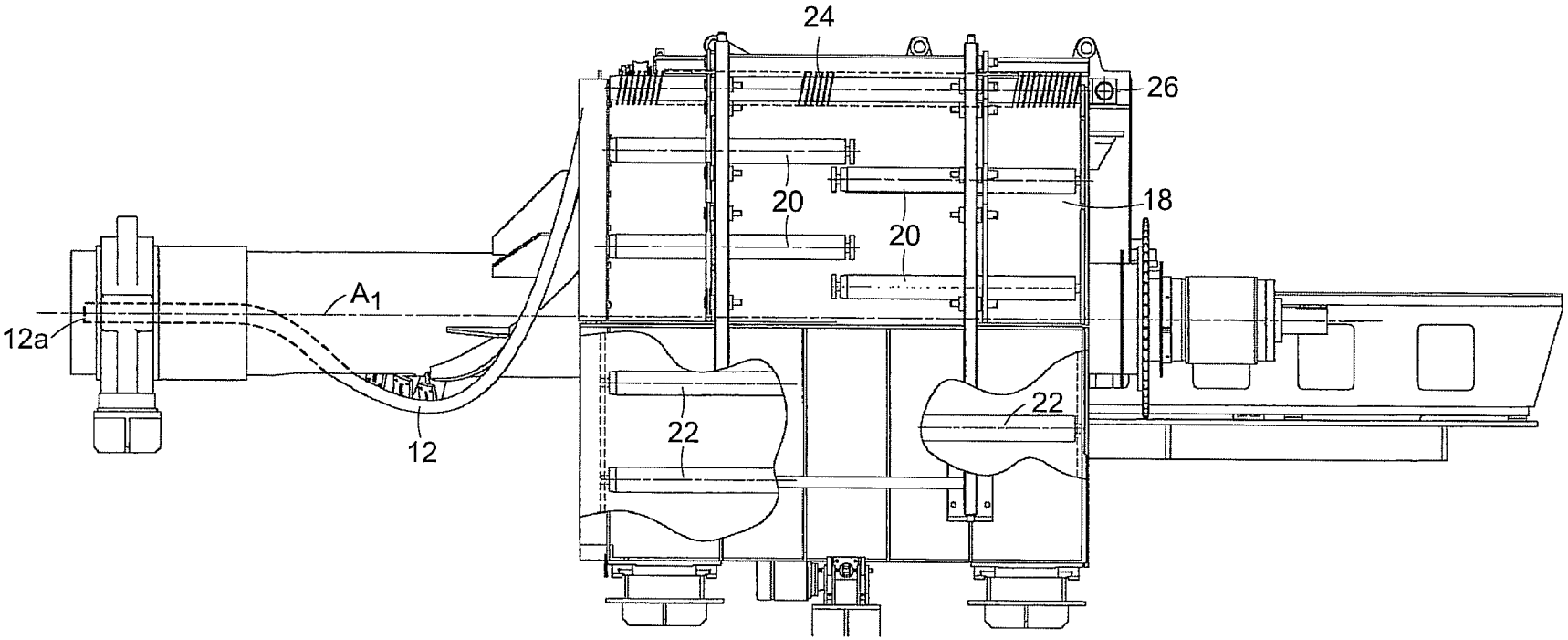

The apparatus may optionally include a means for urging and controlling the ordered shifting of the helical formation of rings R along the surface of the drum 14. As depicted in FIGS. 4 and 5, one such means comprises a screw 24 spaced radially from the top of the drum surface and extending in a direction parallel to axis $A_1$. The screw is carried by the shroud 18 and driven by a small gear motor 26. The individual rings R are received between the spiral threads of the screw and are thus propelled along the drum surface in an ordered spacing.

Figure 6:
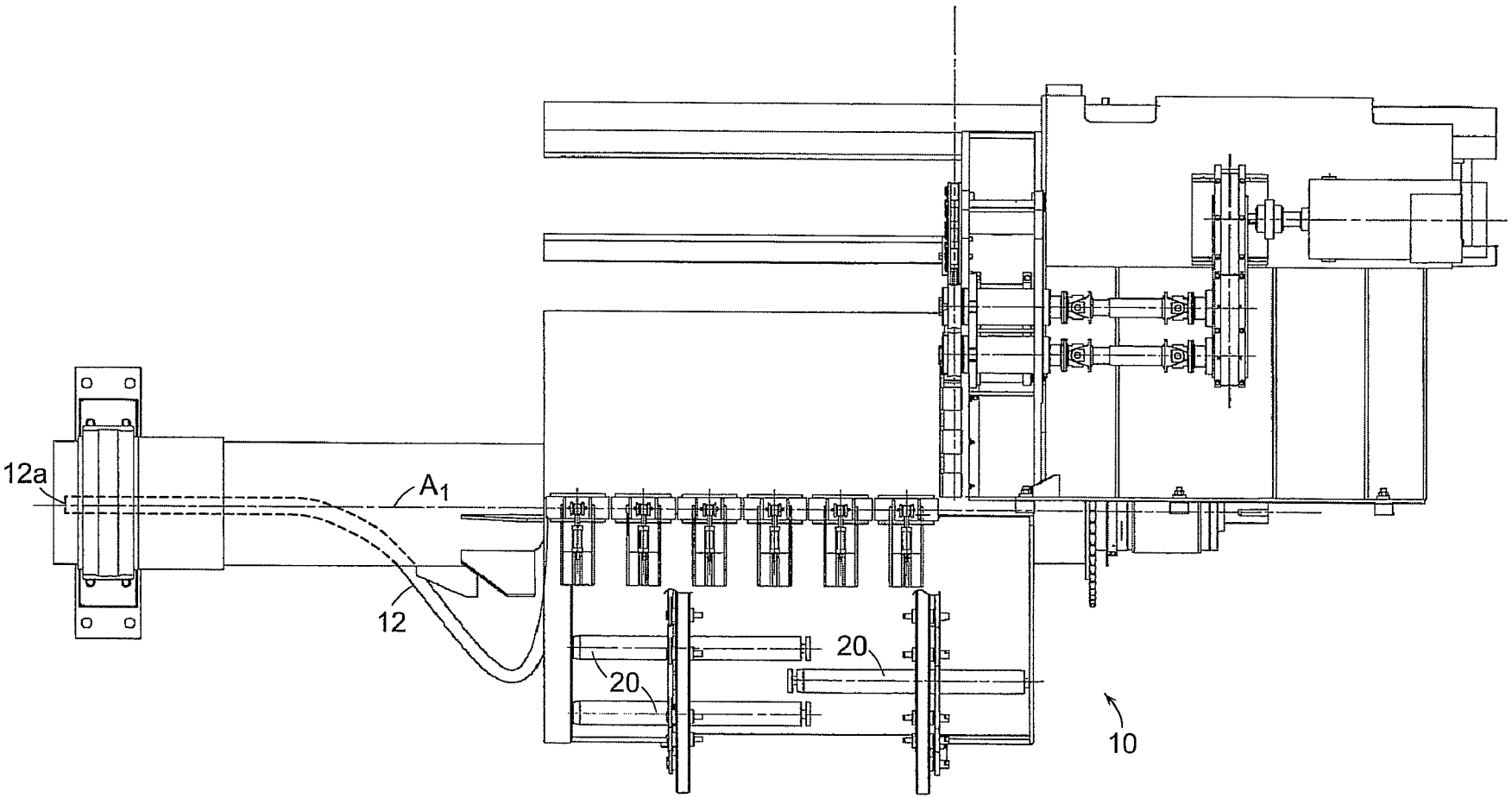
FIGS. 6 and 7 are views similar respectively to FIGS. 1 and 3 showing another embodiment of the means for controlling and urging the ordered shifting of the helical formation of rings along the drum surface.
Figure 7:
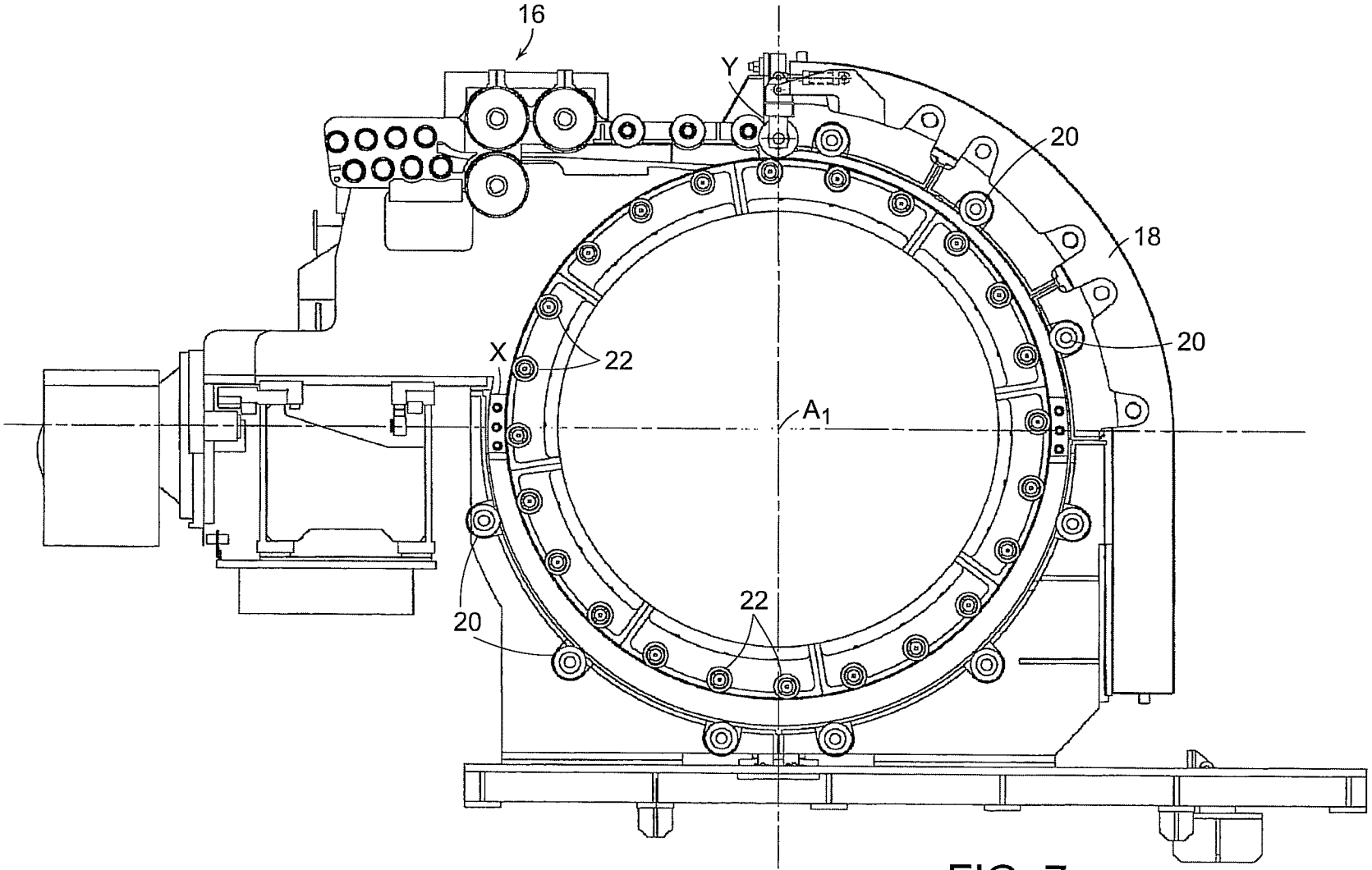
Figure 8:
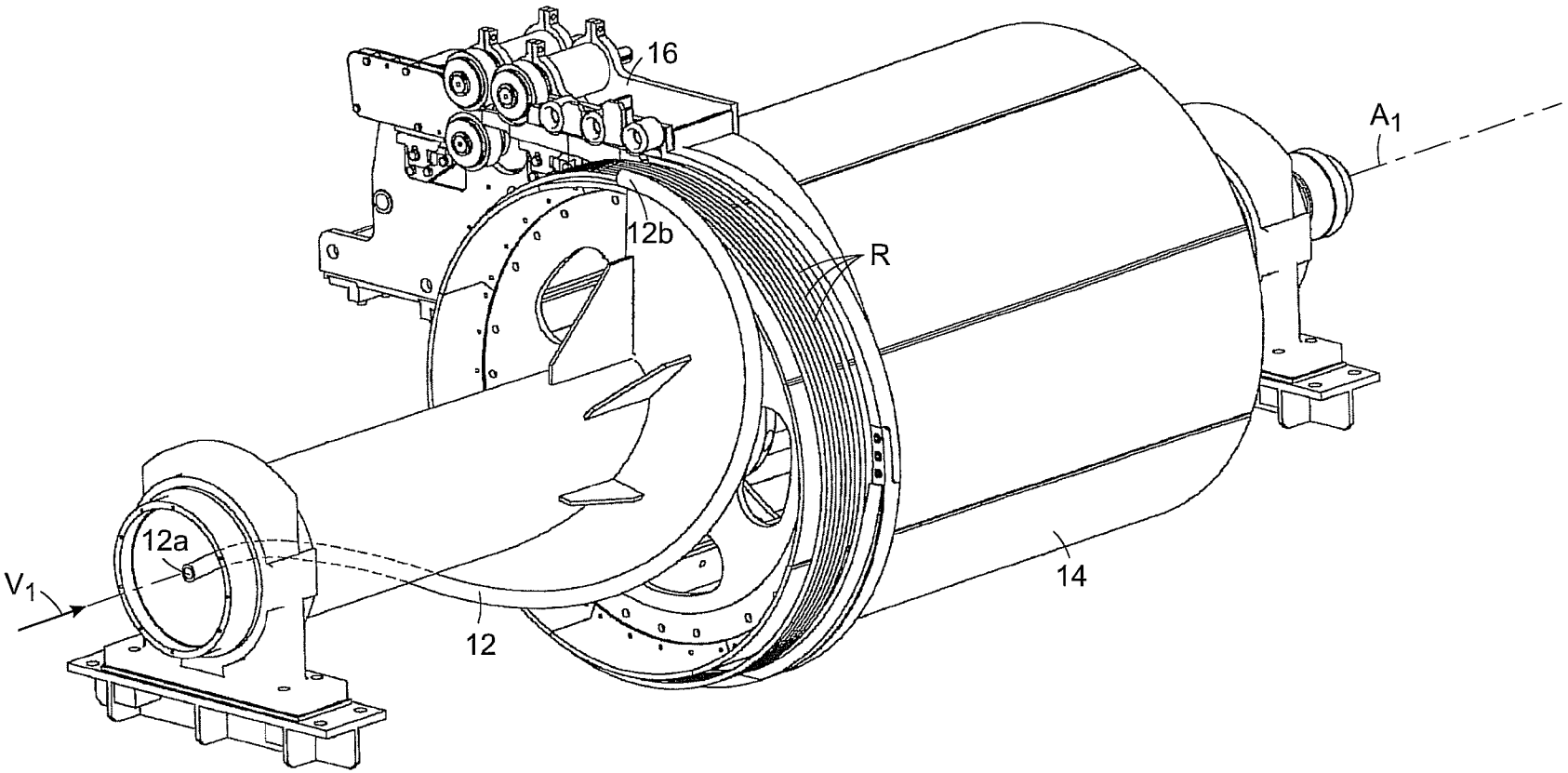
FIG. 8 is a three dimensional illustration of a prior art accumulator.
Figure 9:
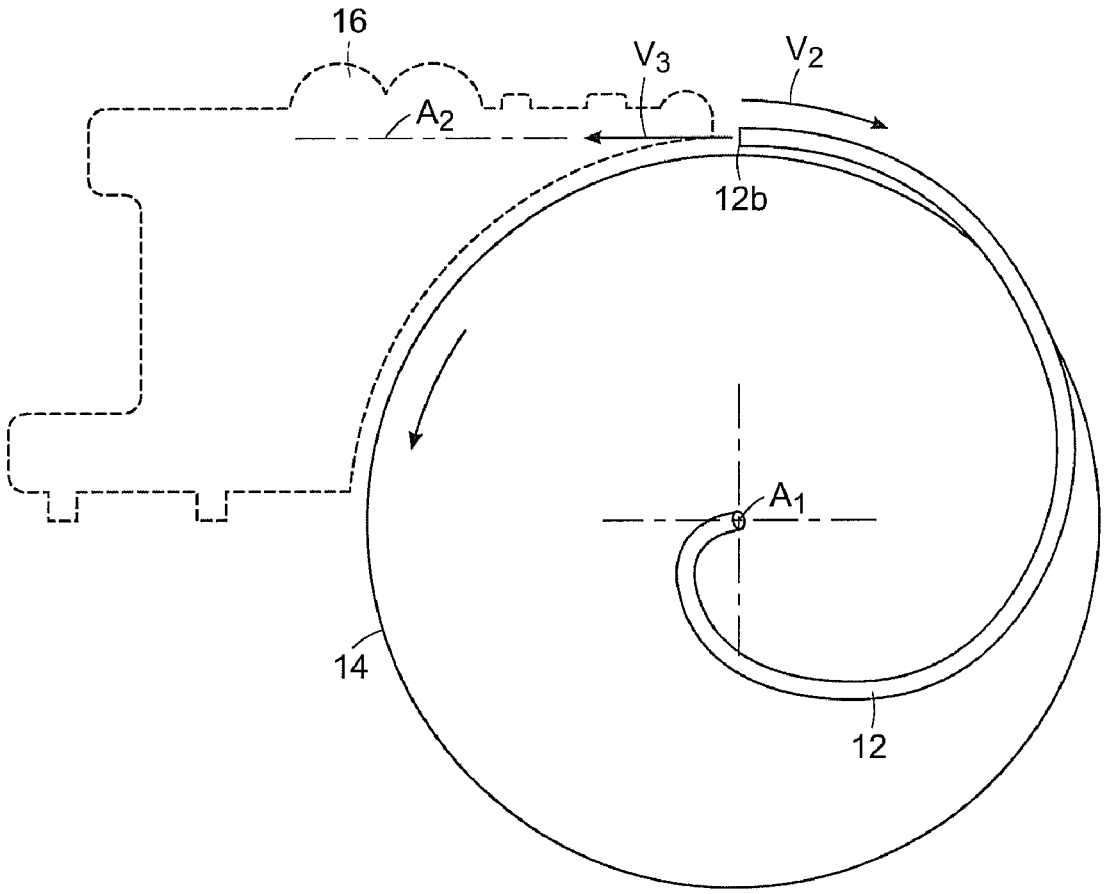
FIG. 9 is a diagrammatic cross sectional view looking downstream from the entry end of the curved guide.

Alternatively, as shown in FIGS. 6 and 7, a plurality of free wheeling pinch rollers indicated typically at 28 may be aligned along the top of the drum 14 in a direction parallel to axis $A_1$. The rollers 28 are arranged to pinch an upper region of the helical ring formation against the drum surface.

The invention claimed is:

1. Apparatus for decelerating and temporarily accumulating a hot rolled product moving longitudinally along a first axis at a first velocity $V_1$, said apparatus comprising:

a curved guide having an entry end aligned with said first axis to receive said product, and having an exit end spaced radially from said first axis and orientated to deliver said product in an exit direction transverse to said first axis, said curved guide being rotatable about said first axis in a direction opposite to said exit direction and at a speed at which said exit end has a second velocity $V_2$ lower than $V_1$ and such that said product is delivered from said exit end as a helical formation of rings and at a third velocity $V_3$ equal to $V_1-V_2$;

a cylindrical drum arranged to axially receive said helical formation of rings, said drum being rotatable about said first axis, in a direction opposite to the direction of rotation of said curved guide and at a speed such that said product is unwound from said drum at said third velocity;

receiving means movable along a path parallel to said first axis for receiving the product being unwound from said drum;

a shroud configured to partially encircle said drum; and rotatable interior rollers circumferentially spaced around the interior of said shroud said interior rollers being spaced radially from the surface of said drum and extending in parallel relationship with said first axis.

2. The apparatus of claim 1 further comprising rotatable exterior rollers circumferentially spaced around the surface of said drum, said exterior rollers also extending in parallel relationship with said first axis.

3. The apparatus of claim 1 wherein said interior rollers are staggered in the direction of said first axis, with overlapping ends.

4. The apparatus of claim 2 wherein said exterior rollers are staggered in the direction of said first axis, with overlapping ends.

5. The apparatus in accordance with any one of claims 1-4 wherein said shroud is arranged outside of the path of said receiving means.

6. The apparatus of claim 2 or 4 wherein said exterior rollers are arranged around the entire circumference of said drum.

7. The apparatus of claim 1 wherein said interior rollers are arranged to radially confine the helix received on said drum.

8. The apparatus of claim 2 wherein said exterior rollers are arranged to radially support the helix received on said drum.

9. The apparatus of claim 1 or 2 further comprising means for urging and controlling the ordered shifting of said helical formation of rings along the surface of said drum.

10. The apparatus of claim 9 wherein said means for urging and controlling comprises a rotating screw radially spaced from the drum surface and extending in a direction parallel to said first axis.

11. The apparatus of claim 9 wherein said means for urging and controlling comprise a plurality of rollers arranged to pinch an upper region of said helical ring formation against the surface of said drum.

* * * * *